US007587962B2

(12) United States Patent
Marks et al.

(10) Patent No.: US 7,587,962 B2
(45) Date of Patent: Sep. 15, 2009

(54) RATCHETING HANDLE FOR A TOOL

(76) Inventors: Joel S. Marks, 3757 Sheridge Dr., Sherman Oaks, CA (US) 91403; Stephen Quick, 18 Worcester St., West Boylston, MA (US) 01583

( * ) Notice: Subject to any disclaimer, the term of this patent is extended or adjusted under 35 U.S.C. 154(b) by 52 days.

(21) Appl. No.: 11/743,266

(22) Filed: May 2, 2007

(65) Prior Publication Data

US 2008/0271578 A1 Nov. 6, 2008

(51) Int. Cl.
*B25B 13/58* (2006.01)

(52) U.S. Cl. ..... 81/185; 81/58.4; 81/160; 81/162

(58) Field of Classification Search ..... 81/58.4, 81/160, 162, 185
See application file for complete search history.

(56) References Cited

U.S. PATENT DOCUMENTS 4,541,310 A 9/1985 Lindenberger
5,467,874 A * 11/1995 Whitaker ..... 206/378
5,573,093 A * 11/1996 Lee ..... 192/43.2
5,622,090 A 4/1997 Marks
5,680,800 A 10/1997 Sharpe
5,791,209 A 8/1998 Marks
5,988,337 A * 11/1999 Liu ..... 192/43.1
6,023,999 A 2/2000 Cho
6,082,226 A * 7/2000 Lin ..... 81/62
D449,505 S 10/2001 Glass et al.
6,374,710 B2 4/2002 Kuo
6,748,824 B2 6/2004 Chen
6,792,835 B1 9/2004 Quick et al.
6,928,906 B1 * 8/2005 Marks ..... 81/185
7,036,399 B1 5/2006 Gao et al.
7,055,410 B2 6/2006 Hu
7,055,411 B2 6/2006 Huang

* cited by examiner

*Primary Examiner*—Joseph J Hail, III
*Assistant Examiner*—Shantese L McDonald
(74) *Attorney, Agent, or Firm*—Paul Y. Feng; Fulwider Patton LLP

(57) ABSTRACT

A ratcheting handle having a ratchet device, an asymmetrical, triangular-shaped grip, and a tool adapter connected to the grip by the ratchet device, and a selector for changing the ratcheting direction of the ratchet device. The selector has a cylindrical wall that surrounds the tool adapter, guides the tool into engagement with the tool adapter, and stabilizes the tool when the grip is being rotated. The tool may be a conventional socket tool or a universal socket tool having a plurality of pins that are closely packed in parallel to each other and which move in accordance with the size of the fastener. The grip includes a first gripping portion extending below the rotational axis of the ratchet device and a second gripping portion extending above the rotational axis.

17 Claims, 8 Drawing Sheets

RATCHETING HANDLE FOR A TOOL

FIELD OF THE INVENTION

The present invention relates generally to a ratcheting driver tool. More precisely, the present invention relates to a ratcheting handle with a direction selector for receiving a socket tool.

BACKGROUND OF THE INVENTION

When using a conventional wrench, it is often inconvenient or impossible to torque and rotate a bolt, screw, nut, or other fastener without the user having to periodically reposition his or her hand on the tool handle and/or reposition the tool on the fastener. Ratcheting handles on rotating hand tools have been developed to allow the user to rotate the fastener through any number of rotations without having to reposition his hand on the handle or reposition the tool on the fastener. Ratcheting handles, such as those on conventional socket wrenches, have been developed with a direction selector or lever which the user can manipulate to change the ratcheting direction of the handle. The selector allows the ratcheting handle to apply torque to the fastener either clockwise to advance the fastener into the work piece or counterclockwise to withdraw the fastener out of the work piece.

Conventional socket wenches typically have a handle that extends at a ninety degree angle from the rotational axis of the fastener. The long handle and its rotational travel make such wrenches unsuitable for work in tight spaces, such as in an engine bay of an automobile. An extension can be inserted between the socket and the wrench to remove the wrench from the tight space. Of course, this solution requires the user to carry an extra component in his tool set, namely, the extension, and sometimes the extension on hand is still not long enough to completely locate the wrench into open space. Conventional socket wrenches also have a drive block that holds a socket in place, but typically lack additional support for the socket and a mechanism of guiding sockets on the drive block to facilitate rapid attachment/detachment of the socket.

Screwdriver-type ratcheting handles have also been developed with a rotating collar for selecting the ratcheting direction of the handle. Typical screwdriver-type ratcheting handles have narrow, tubular handles, similar to conventional screwdriver handles, which are suitable for low torque applications. However, such narrow, tubular handles do not provide sufficient mechanical leverage to develop the torque necessary for jobs that normally require use of a wrench. Also, a user of such narrow, tubular handles usually must grasp the handle in such a way that his palm rests on one side of the handle causing his wrist to be located off to another side of the handle. When a handle must be grasped in this way, it may be difficult for the user to apply sufficient axial force to keep the tool pressed on the fastener while simultaneously applying a large amount of torque to the fastener.

Persons skilled in the art have recognized a need for a ratcheting handle that can be used in tight spaces and which provides increased mechanical leverage. There is also a need for a ratcheting handle that allows a user to quickly change ratcheting direction without having to remove or disengage the tool from the fastener. A need also exists for a ratcheting handle that allows for rapid attachment of tools to the handle and that provides stability to the attached tool. The present invention in various embodiments satisfies many of these and other needs.

SUMMARY OF THE INVENTION

Briefly and in general terms, the present invention is directed to a ratcheting handle with a direction selector for receiving a socket tool. In various embodiments, the ratcheting handle includes a ratchet device including a means for ratcheting, a lock mechanism, a forward portion, and a rear portion, the ratchet device configured such that the rear portion is rotatable relative to the forward portion, the lock mechanism movable between a first orientation in which the rear portion is prevented from rotating in a first direction relative to the forward portion and a second orientation in which the rear portion is prevented from rotating in a second direction relative to the forward portion. The handle includes a grip attached to the rear portion of the ratchet device. The handle accepts a socket tool or like device including a forward segment, a recess formed in the forward segment, an adjusting mechanism disposed within the recess, and a rear segment attached to the forward portion of the ratchet device, the recess sized to receive at least a portion of the fastener, the adjusting mechanism moving in accordance with the predetermined size of the fastener when the socket device is pushed onto the fastener. The handle further includes a selector coupled to the lock mechanism, the selector including a forward end, an inward facing surface, an outward facing surface, and a forward aperture formed at the forward end and sized to receive the socket device, the inward facing surface surrounding the rear segment of the socket device, the outward facing surface positioned to be manipulated by a user of the tool to move the lock mechanism from the first orientation to the second orientation and from the second orientation to the first orientation.

In one embodiment, the adjusting mechanism includes a plurality movable pins extending axially within the recess of the socket device, the pins moving axially and independently of each other between a forward position and a rear position, and the pins are attached to the socket device such that when the socket device is pushed onto the fastener, a first number of the pins move from the forward position to the rear position and a second number of the pins remain at the forward position, and when torque is applied to the grip by a user, the applied torque is transferred to the fastener by the second number of the pins.

The ratcheting handle has an axis of rotation and the grip may include triangular shaped grip portions with peaks located away from the axis of rotation, improving the lever arm and mechanical advantage when the user applies torque to the grip. Also, the grip may include a curved, convex shaped rearward facing surface to allow axial pressure to be applied to the tool by the user to assist in advancing the fastener into the work piece.

The features and advantages of the invention will be more readily understood from the following detailed description which should be read in conjunction with the accompanying drawings.

DETAILED DESCRIPTION OF THE PREFERRED EMBODIMENTS

Figure 1:
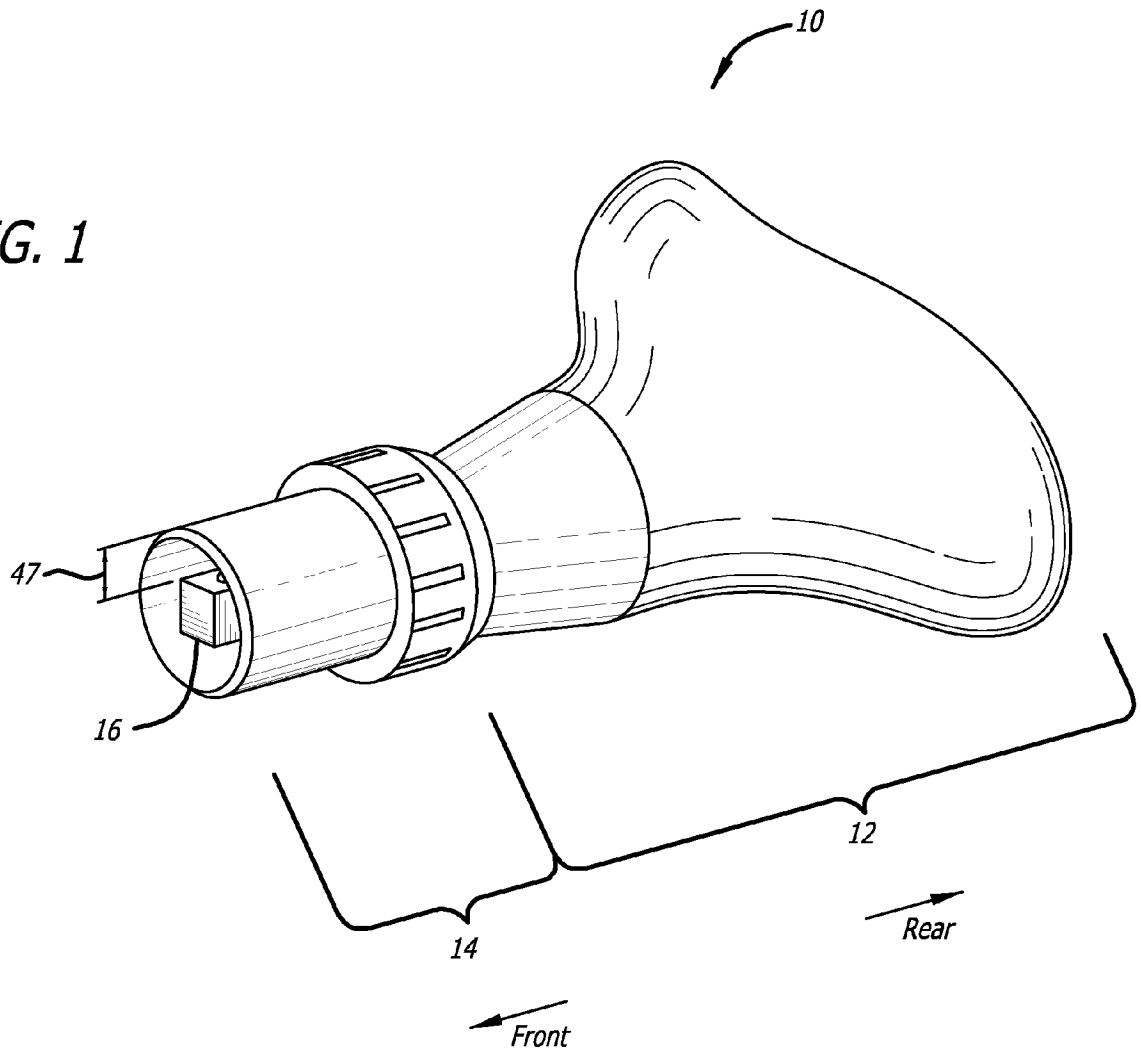
FIG. 1 is a perspective view of a ratcheting handle showing a grip, a selector in front of the grip, and a tool adapter disposed within a recess of the selector.

Referring now in more detail to the exemplary drawings for purposes of illustrating embodiments of the present invention, wherein like reference numerals designate corresponding or like elements among the several views, there is shown in FIG. 1 a ratcheting handle 10 adapted for use with a driving tool, which may be removably or permanently attached to the handle 10. When the tool is attached to the handle 10, a user can rotate the tool in a selected direction by grasping and rotating the handle in the selected direction. In this way, a fastener to be driven by the tool may also be rotated in the selected direction. The handle 10 has a ratcheting function, which allows the user to rotate the handle in a direction opposite the selected direction without rotating the tool. In this way, the user can rotate the tool and the fastener through an unlimited number of rotations in the selected direction without him letting go of the handle 10 and without removing or disengaging the tool from the fastener. This arrangement enables the user to quickly, efficiently, and with low effort to drive a fastener into or withdraw a fastener from a work piece.

In the preferred embodiment of FIG. 1, the handle 10 includes an ergonomically shaped grip 12 having an asymmetrical triangular shape with a long, curved bottom, a forward curving back, and a projection at the top. A barrel-like direction selector 14 is located in front of the grip 12. A tool adapter 16 for securing a tool is centrally located within the selector 14 and is accessible through a forward facing aperture formed in the selector 14. In use, a tool is inserted into the forward facing aperture and pushed into engagement with the tool adapter 16. Preferably, the selector 14 rotates with the tool adapter 16 and the attached tool as the user rotates the handle 10 in that same direction. Advantageously, because the selector 14 rotates with the tool, tool rotation cannot inadvertently shift or change the ratcheting direction of the handle 10.

Figure 2:
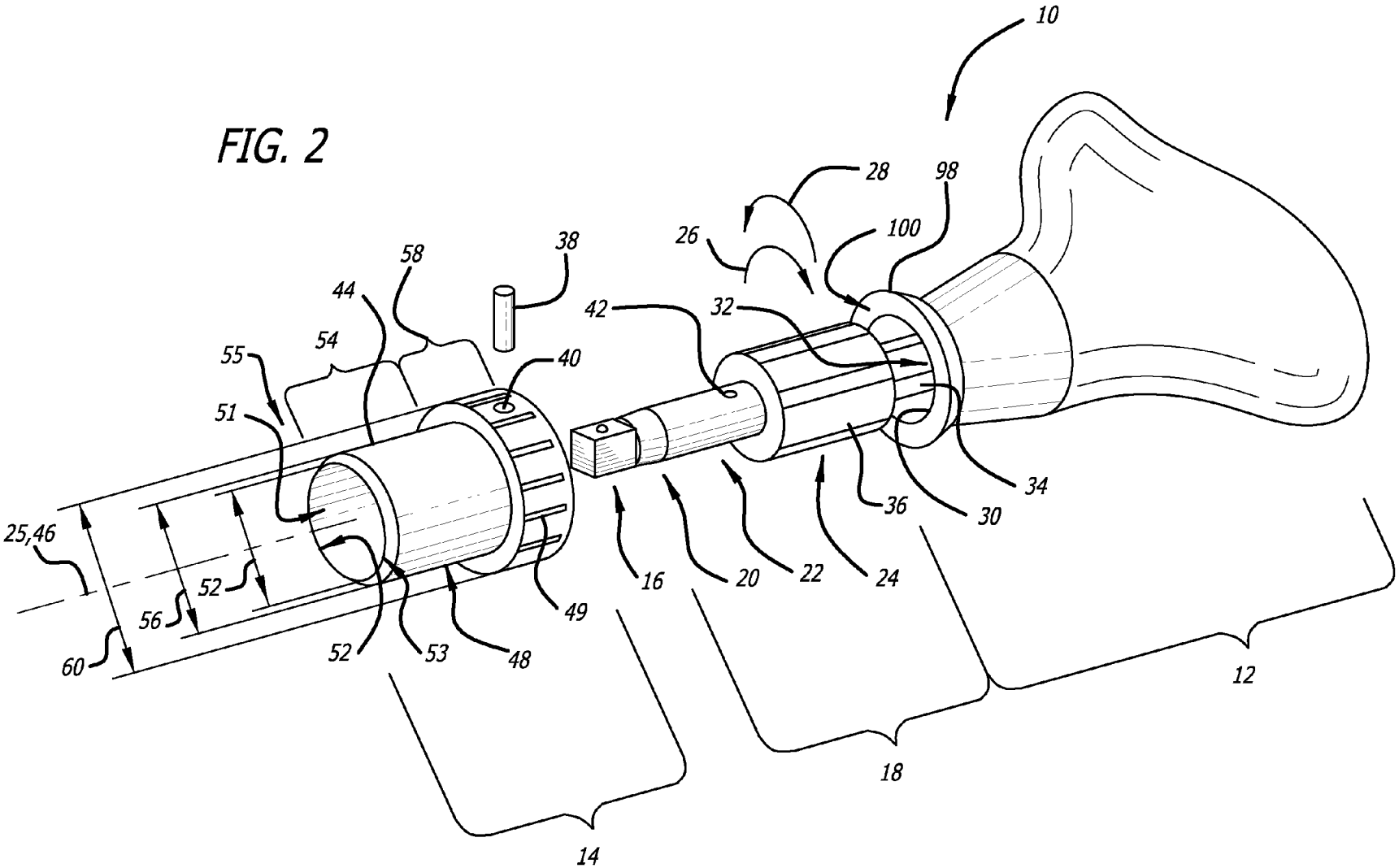
FIG. 2 is an exploded, perspective view from the front of the ratcheting handle of FIG. 1 showing a ratchet device having a forward end attached to the tool adapter, a lock mechanism coupled to the selector by means of a pin, and a rear portion having ribs that mate with grooves in a grip cavity formed in the grip.

As shown in FIG. 2, the handle 10 includes a ratchet device 18, which is normally enclosed within the grip 12 and selector 14. The ratchet device 18 has a forward portion 20 transitioning to the tool adapter 16, a lock mechanism 22, and a rear portion 24 engaging the grip 12. The ratchet mechanism uses a conventional pawl biased into a gearwheel or rack (not shown), or a double pawl and gearwheel or rack arrangement could be used for selective forward and reverse ratcheting capability (described in more detail below). The rear portion 24 is rotatable relative to the forward portion 20 about a rotational axis 25 of the ratchet device 18. The lock mechanism 22 is movable between a first orientation and a second orientation. In the first orientation, the rear portion 24 is locked against, or otherwise prevented from, rotating in a first direction 26 relative to the forward portion 20. In the second orientation, the rear portion 24 is prevented from rotating in a second direction 28 relative to the forward direction.

Figure 8:
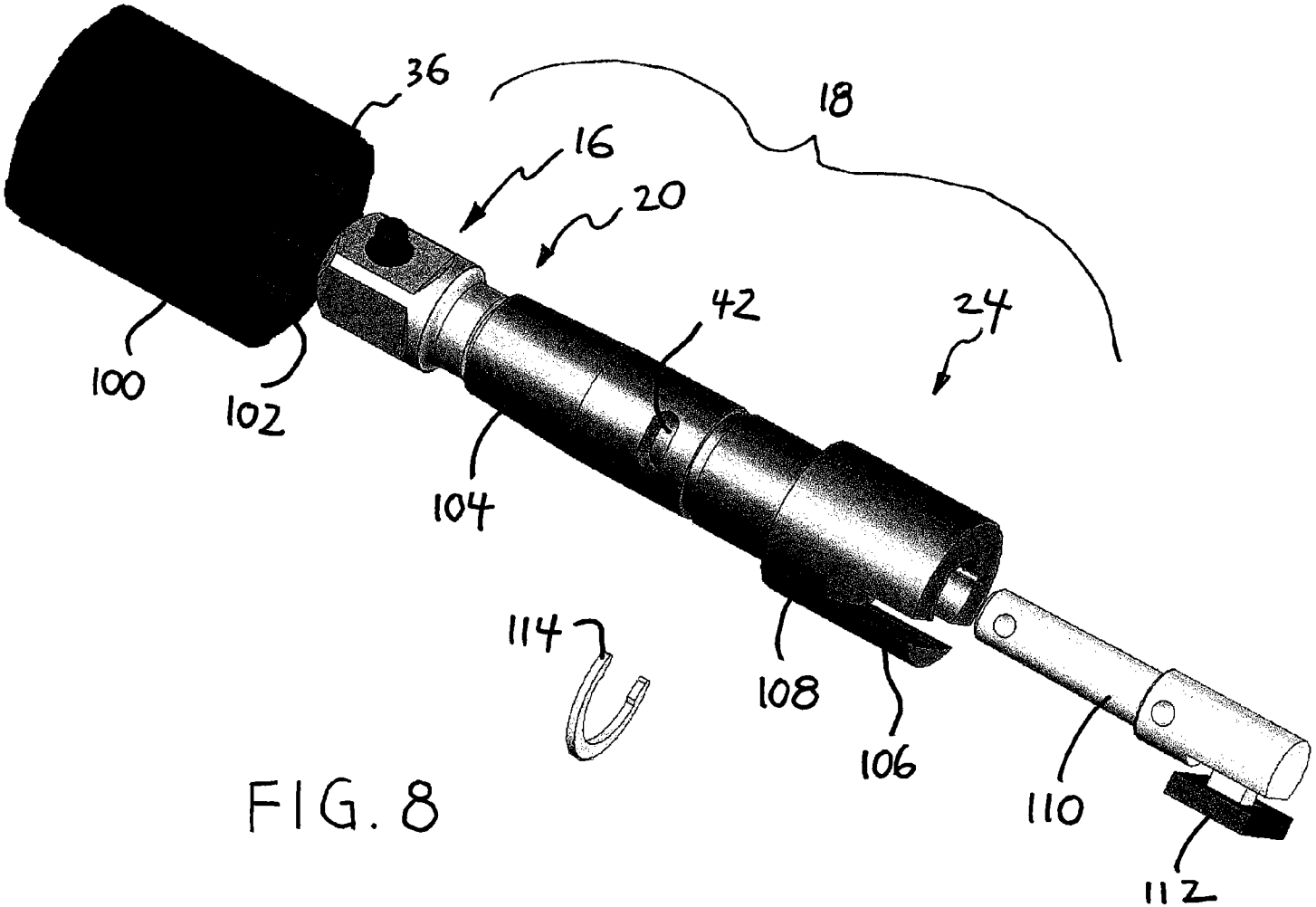
FIG. 8 is an exploded, perspective view of a preferred embodiment pawl and gear ratcheting device.

FIG. 8 is a preferred embodiment of the ratchet device 18. The ratchet device 18 has a shaft made from a front barrel 104 receiving a rear barrel 108 therein, which receives a switch rod 110 therethrough. The shaft has the tool adapter 16 at the front end and a slot 106 at the back end to receive the switch rod 110, wherein a spring-loaded, square shaped pawl 112 slides within the slot 106. A snap ring 114 holds the shaft assembly components together. A radial lock pin 38 passes through the selector switch opening or recess 42 to hold the switch rod 110 inside the shaft. The grip 12 fits over the retainer 100. Rotating the grip 12 rotates the retainer 100, which has ribs 36 on its opening or recess 42 to hold the switch rod 110 inside the shaft. The grip 12 fits over the retainer 100. Rotating the grip 12 rotates the retainer 100, which has ribs 36 on its outside circumference that transmit torque between it and the grip. The retainer 100 overlies the rear portion 24 of the shaft where the edges of the square-shaped pawl 112 selective engage the internal teeth 102 of the retainer 100. The selector 14 overlies the recess 42, wherein the radial lock pin 38 engages the selector 14, thereby linking the selector 14 to the pawl 112 via the switch rod 110. Rotating the selector 14 in the first or second directions 26, 28 of FIG. 2 slides the pawl 112 into engagement or disengagement with the internal teeth 102 at one side of the retainer 100 or the other. This enables torque transmission while rotating in one direction while ratcheting freely in the opposite direction. More details of the ratchet mechanism can be found in, for example, U.S. Pat. No. 5,038,452 (Beugelsdyk et al.), or U.S. Pat. No. 5,582,081 (Lin), the contents of which are hereby incorporated by reference.

The grip 12 has a forward facing aperture 30 leading to a grip cavity 32 formed into the grip. Preferably, axially extending grooves 34 are formed at the interior walls of the grip cavity 32 and axially extending ribs 36 are formed on the rear portion 24 of the ratchet device 18. When assembled, the grooves 34 and ribs 36 interlock to ensure that the rear portion 24 and grip 12 rotate together. The grooves 34 and ribs 36 may be replaced with a friction fit, adhesive bond, a radially extending roll pin, a single groove and tooth, etc., to interlock the rear portion 24 to the grip 12.

In FIG. 2, the selector 14 is coupled to the lock mechanism 22 by a radial lock pin 38, which extends through a side-facing aperture 40 formed through the selector and extending into a recess 42 formed in the ratchet device 18. Preferably, the selector 14 is somewhat barrel-shaped and includes a cylindrical wall 44 which helps support or retain a tool therein. The cylindrical wall 44 extends axially in a direction parallel to the rotational axis 25 of the ratchet device 18. The cylindrical wall 44 defines a central axis 46 of the selector 14 and has an outward facing surface 48 that faces away from the central axis and an inward facing surface 50 that faces toward the central axis. The central axis 46 is preferably coaxial and coincides with the rotational axis 25 of the ratchet device 18.

Figure 4:
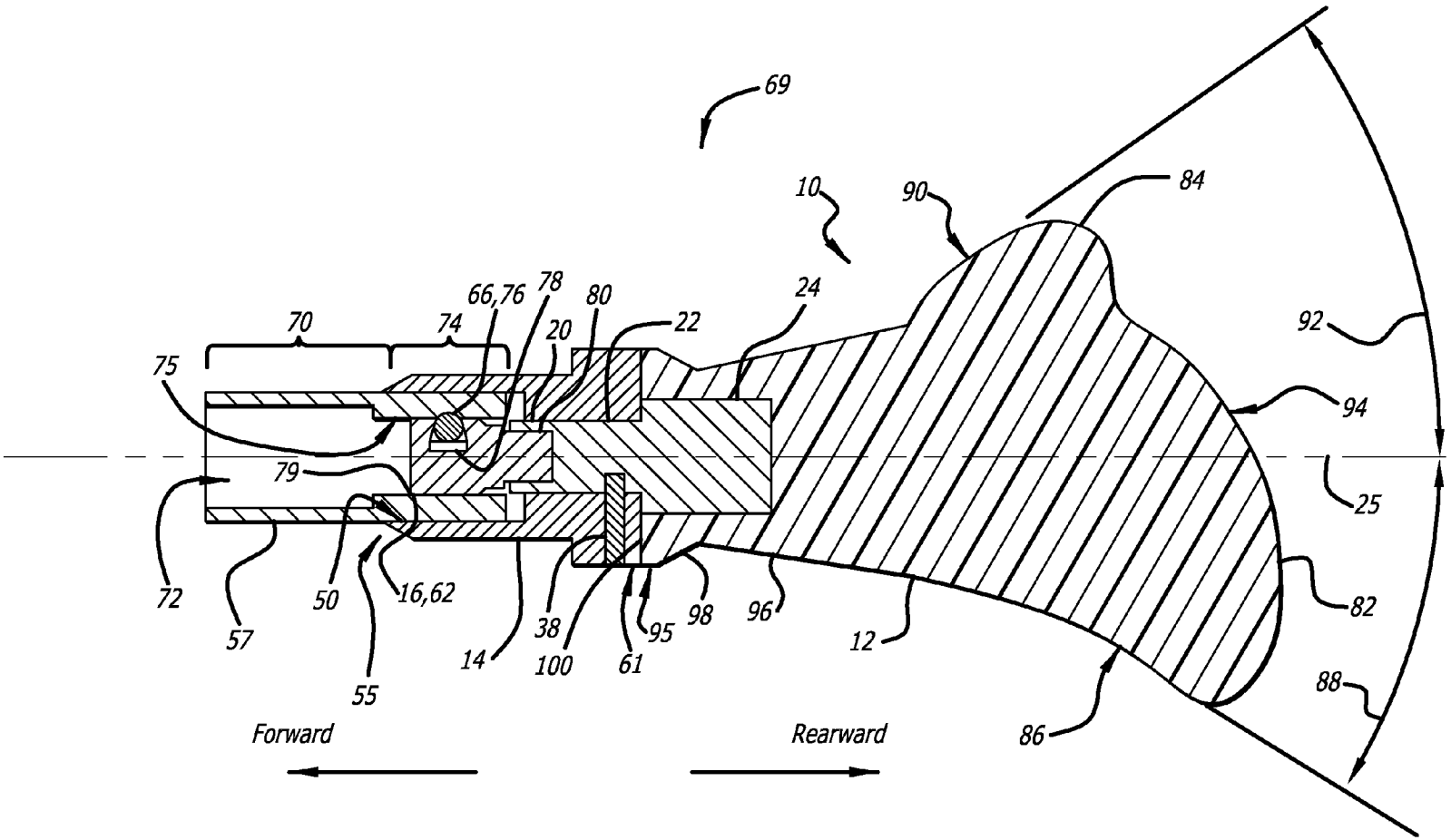
FIG. 4 is cross-sectional view of an assembled ratcheting socket tool showing a socket at the front end of the tool, a selector surrounding a rear segment of the socket, a drive block securing the socket, a grip having a forward facing surfacing abutting a rear end of the selector, and a ratchet device having a forward end attached to the drive block.

The inward facing surface 50 of the selector 14 defines a tool recess 51 having an inner diameter 52 sized to accommodate a portion of the tool that is to be attached to the tool adapter 16. This inner diameter 52 is preferably 1.030±0.002 inch so that it readily accepts standard socket tools having an outside diameter of one inch or less, so there is a gap of about 0.030±0.002 inch between the tool 57 O.D. and the selector 14 I.D. Through empirical observations, these dimensions create a preferred fitment that provides sufficient axial support and guidance of the tool 57 by the selector barrel for installation and use, yet preserves adequate clearance so that the tool 57 can be easily detached from the selector 14. The tool recess 51 extends from a forward aperture 53 circumscribed by an optional chamfer, formed at the forward end 55 of the selector 14 and is sized to receive a socket tool 57. When assembled, the inward facing surface 50 surrounds the tool adapter 16. Also, the inward facing surface 50 is spaced a radial distance 47 (FIG. 1) apart from the tool adapter and located to be adjacent to an exterior of a portion of the tool attached to the tool adapter 16 (FIG. 4). The inward facing surface 50 can be used to physically guide the tool into engagement with the tool adapter 16, and provides further lateral support for the tool during use. As such, the inward facing surface 50 facilitates rapid attachment of the tool to the handle 10 and provides stability to the attached tool when the handle is rotated by the user.

The outward facing surface 48 of the selector 14 may be manipulated by the user to move the lock mechanism 22 of the ratchet device 18 from the first orientation and the second orientation. Preferably, the selector 14 is wider toward the rear of the handle 10 in that the outward facing surface 48 has a forward area 54 with a forward outer diameter 56 and a rear area 58 with a rear outer diameter 60 that is greater than the forward outer diameter 56, creating a slight taper or step. Preferably, one or more grooves 49 may be formed to allow the user to more easily grasp and manipulate the selector 14. The grooved surface may be replaced by or supplemented by a knurled surface, a checkered surface, a fluted surface, a knobbed surface, or any anti-slip surface finish or treatment. In the embodiment shown, the grooves 49 are formed in the rear area 58 corresponding to outer diameter 60 so that they are adjacent the grip 12 when the handle 10 is assembled. Thus arranged, the grooves 49 and the change in diameter of the selector 14 provide tactile feedback to the user, thereby allowing the user to readily locate the selector on the handle 10 even though the tool and handle are not within eyesight. Furthermore, by pressing against the grooves 49 with an extended index finger, the user can conveniently rotate the selector 14 into either the first orientation or the second orientation without having to release the handhold on the grip 12.

Figure 3:
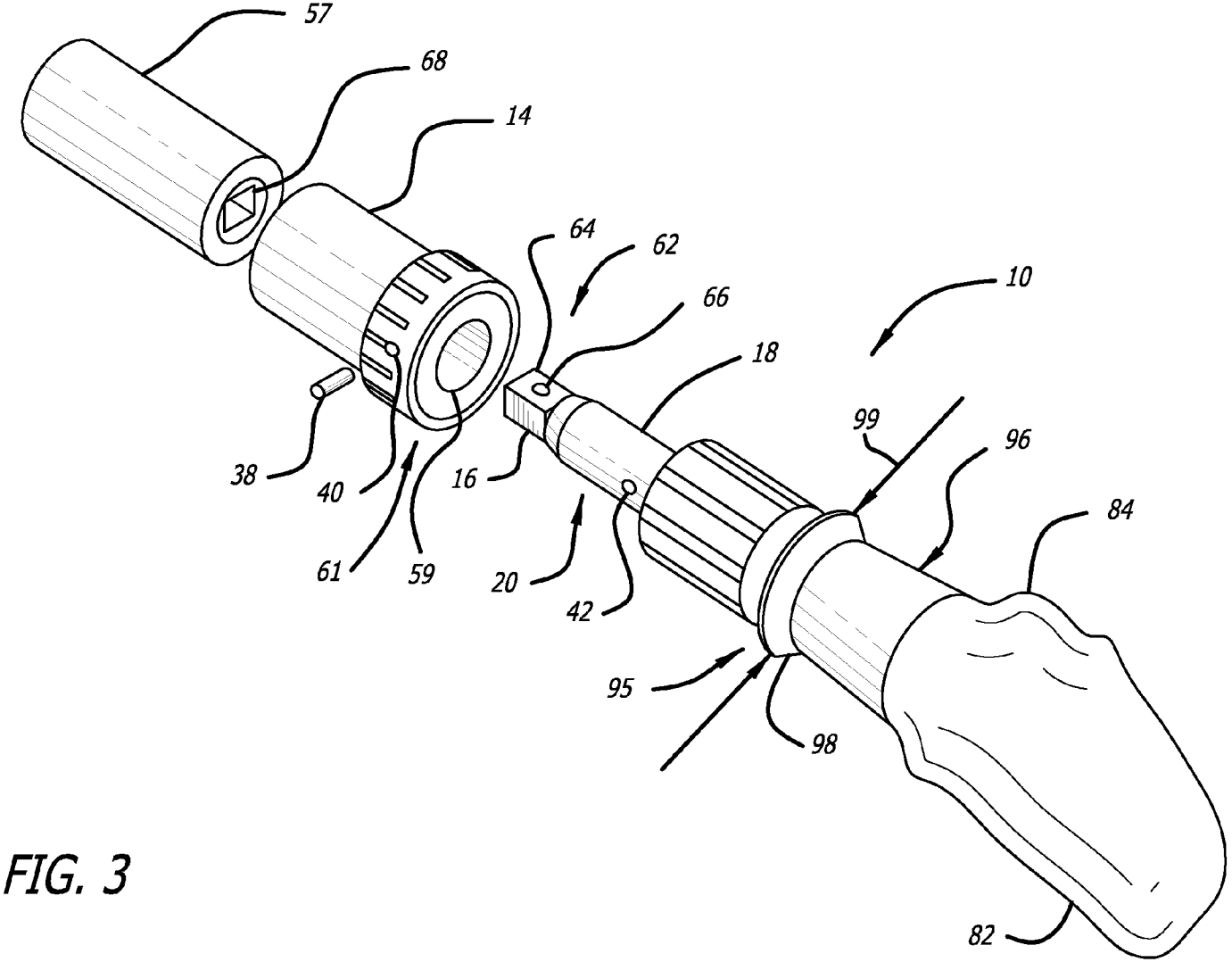
FIG. 3 is an exploded, perspective view from the rear of the ratcheting handle of FIG. 1 showing a drive block attached to the forward portion of the ratchet device and sized to fit into a square aperture formed in a tool, a rear aperture formed in the selector and sized to receive the forward portion of the ratchet device, and a forward flange on the grip.

In FIG. 3, a socket-type tool 57 is shown detached from the tool adapter 16 of the disassembled handle 10 of FIG. 2. A rear aperture 59 is formed at the rear end 61 of the selector 14 and is sized to receive the forward portion 20 of the ratchet device 18 so that the tool adapter 16 is disposed within the tool recess 51 when assembled. The tool adapter 16 includes preferably a square-shaped drive block 62 having four side surfaces 64 and a key, detent, or pushing surface 66 protruding from one of the side surfaces. The drive block 62 is sized to mate with a standard socket tool square aperture 68 formed in the tool 57, such that the side surfaces 64 engage and rotate the tool 57 when the grip 12 is rotated by the user.

FIG. 4 is a cross-sectional view of the handle 10 taken along its axis of rotation, and shows a ratcheting socket tool assembly 69. A socket 57 is shown engaged with a drive block 62 of a tool adapter 16. The socket 57 has a forward segment 70 and a forward recess 72 formed in the forward segment 70. The forward recess 72 is sized to receive and engage a fastener, such as a nut or the head of a bolt, having a predetermined size. The forward recess 72 may have a polygonal shape that accommodates a common hexagonal nut or the hex head of the bolt. The socket 57 also has a rear segment 74 attached to the drive block 62 of the tool adapter 16. The drive block 62 may be a standard size for conventional sockets. The side surfaces 64 of the drive block 62 contact the inner surface 75 of the socket 57 while the key or pushing surface 66 of the drive block extends into a retaining recess 76 formed in the inner surface 75 of the socket. Preferably, the tool adapter 16 further includes a biasing device 78, such as a spring, coupled to the pushing surface 66. The biasing device 78 urges the pushing surface 66 into the retaining recess 76 while allowing the pushing surface to move out of the retaining recess when a predetermined amount of force is used to pull apart the socket 57 and the tool adapter 16. Accordingly, in one embodiment, the socket 57 may be attached and disconnected from the handle 10 and replaced with another socket having a different size.

The drive block 62 has a forward tip 79 that is preferably disposed within the tool recess 51 and to the rear of the forward end 55 of the selector 14. As seen in FIG. 4, the drive block 62 is connected to a stem 80 located at the rear end of the tool adapter 16. The stem 80 is fixedly attached to the forward portion 20 of the ratchet device 18. Preferably, the stem 80 includes retainer features, such as grooves and/or ribs, which fixedly engage with corresponding features formed on the forward portion 20 of the ratchet device 18. In other embodiments the tool adapter 16 is integrally formed on the forward portion 20 of the ratchet device 18. In yet other alternative embodiments, the socket 57 is permanently attached directly to the forward portion 20 of the ratchet device 18.

Still referring to FIG. 4, the grip 12 preferably has an asymmetrical cross-section on a plane extending through the rotational axis 25 of the ratchet device 18. In the preferred embodiment the grip 12 has a first gripping portion 82 and a second gripping portion 84 smaller than the first gripping portion 82. The first gripping portion 82 has a first forward facing surface 86 defining a first angle 88 extending entirely beneath the rotational axis 25 in FIG. 4. The second gripping portion 84 has a second forward facing surface 90 that defines a second angle 92 extending entirely above the rotational axis 25 in FIG. 4. In the embodiment shown, the second angle 92 is greater than the first angle 88. In other embodiments, the relationship between the first and second angles 88, 92 is reversed or the angles 88, 92 are the same. In various embodiments, the first angle 88 preferably falls within a range of about 20-40 degrees inclusive and more preferably about 33-35 degrees inclusive, and the second angle 92 preferably falls into a range of about 35-80 degrees inclusive and more preferably about 37-40 degrees inclusive. Empirical observations suggest that these angles provide improved leverage and gripping ergonomics for the user. The grip 12 also has a curved, preferably convex, rearward facing surface 94 that extends from the first gripping portion 82 to the second gripping portion 84. Preferably, at least a portion of the grip 12 is overmolded with a slip-resistant elastomeric material, such as rubber.

Referring to FIGS. 2-4, the forward end 95 of the grip 12 includes a cylindrical outer surface 96 adjacent the first and second, triangular-shaped grip portions 82, 84. As seen in the cross-section of FIG. 4, the outer surface 96 slightly tapers inward and then flares outward to form a forward flange 98 at the forward end 95 of the grip 12. At the forward end 95 of the grip 12, the outer surface 96 has an outer diameter 99 (FIG. 3) that is substantially matched to the rear outer diameter 60 of the selector 14. The forward flange 98 provides tactile feedback as well as a finger rest for the user, which enables the user to quickly distinguish by touch only the region just rear of the selector 14 from the cylindrical outer surface 96 of the grip 12. Also, the forward flange 98 helps to shield the selector 14 from inadvertent manipulation by the user during use.

When assembled, the forward flange 98 may abut the rear end 61 of the selector 14. The forward flange 98 defines a substantially flat, forward facing support surface 100 that may support the rear end 61 of the selector 14. Preferably, the support surface 100 does not rotationally engage the rear end 61 of the selector 14 so that rotation of the grip 12 does cause the selector to also rotate and inadvertently shift the orientation of the lock mechanism 22 of the ratchet device 18. For example, a small diameter thrust washer or built-in conical face (not shown) may rest between rear end 61 and forward flange 98 to minimize a frictional torque connection between the respective parts.

Figure 5:
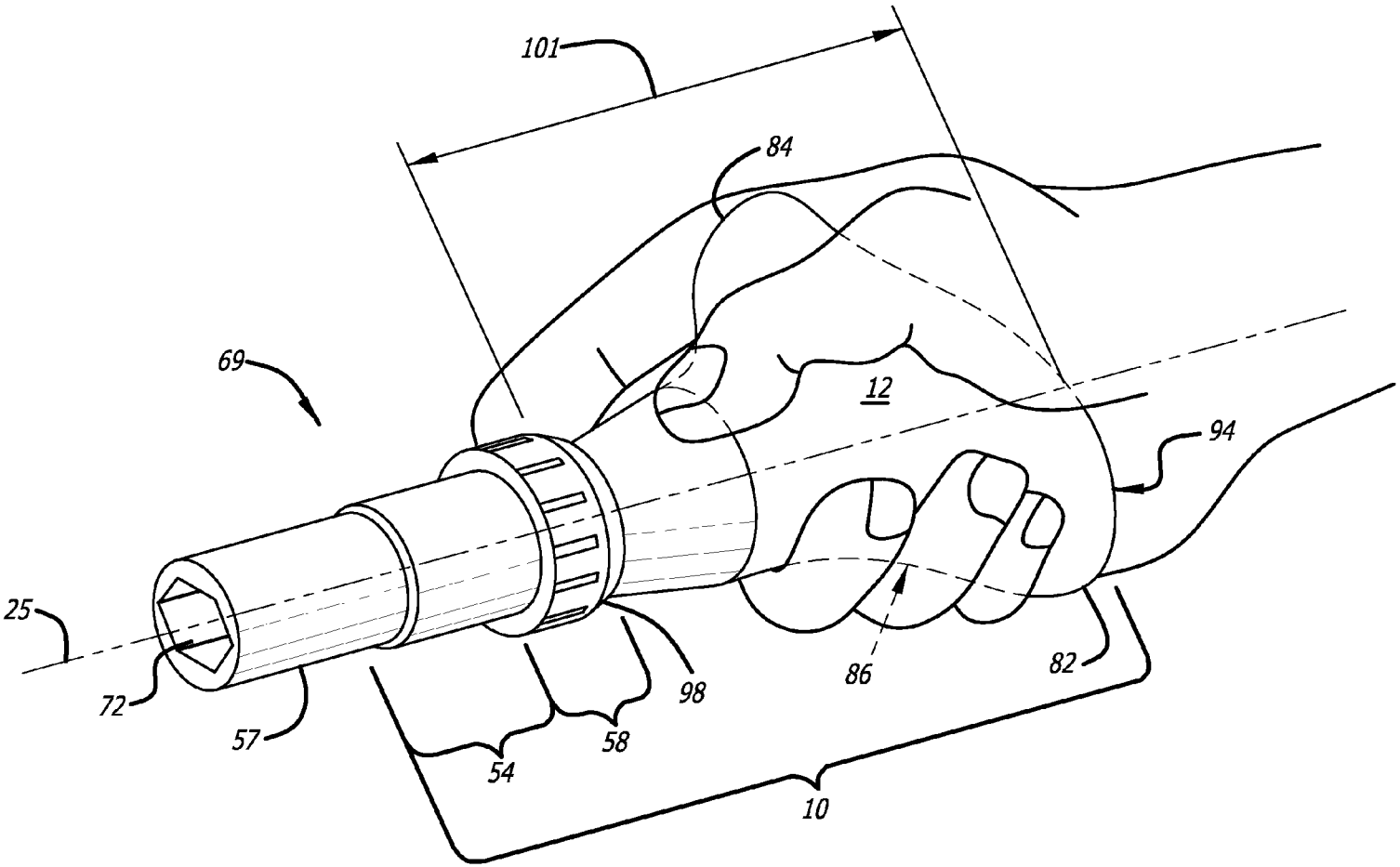
FIG. 5 is a perspective view of the ratcheting socket tool of FIG. 4 showing the middle finger, ring finger, and little finger of a user wrapped around a first forward facing surface of a first gripping portion of the grip, the index finger and thumb of the user wrapped around a second gripping portion of the grip, and the palm of the user pushing a rearward facing surface of the grip.

In FIG. 5, the ratcheting socket tool assembly 69 of FIG. 4 is shown in use. The first and second gripping portions 82, 84 extend outwardly in opposite directions from the rotational axis 25 to make it easier for a user grasping the grip 12 to apply greater torque to the handle 10 than would otherwise be possible with a narrow, tubular handle. The second gripping portion 84 is shaped to fit between the user's thumb and index finger. The first gripping portion 82 is shaped to allow the user's other fingers to wrap around the first forward facing surface 86 of the first gripping portion 82.

Furthermore, the peaks or vertices of the triangular shaped first and second gripping portions 82, 84 increase the lever arm by locating a gripping point far away from the axis of rotation, as compared to a straight-barrel handle in a conventional screw driver for example. This lever arm translates to increased leverage and greater achievable torque transmitted to the socket tool.

The rearward facing surface 94 of the grip 12 is curved so that it rests comfortably in the palm of the user. In this way, the rearward facing surface 94 provides a large surface for the user's palm to push the handle 10 axially forward so that the socket remains engaged with a fastener. The rearward facing surface 94 of the grip 12 is located at an axial distance 101 from the rear area of the selector 14. In one embodiment, the axial distance 101 is about 10 centimeters (about 4 inches). Preferably, the axial distance 101 is selected such that the user can place his or her index finger on the rear area 58 of the selector 14 while the rest of his hand is wrapped around the grip 12. This allows the user to quickly and optionally change the ratcheting direction of the handle without having to remove the tool from the fastener or reposition his hand on the grip 12.

Figure 6:
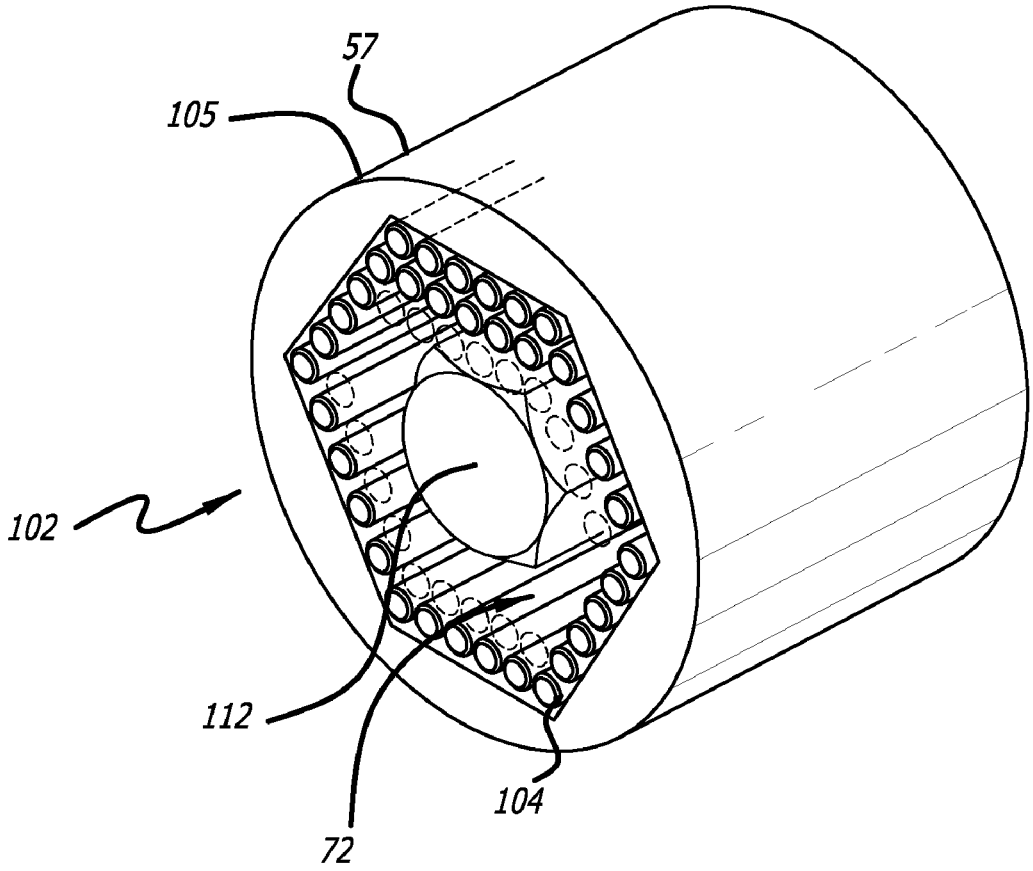
FIG. 6 is a perspective view of a self-adjusting, universal socket tool showing a cavity formed in the socket, a plurality of movable pins disposed within the cavity and biased outward, and a spacer pin centrally disposed among the movable pins.
Figure 7:
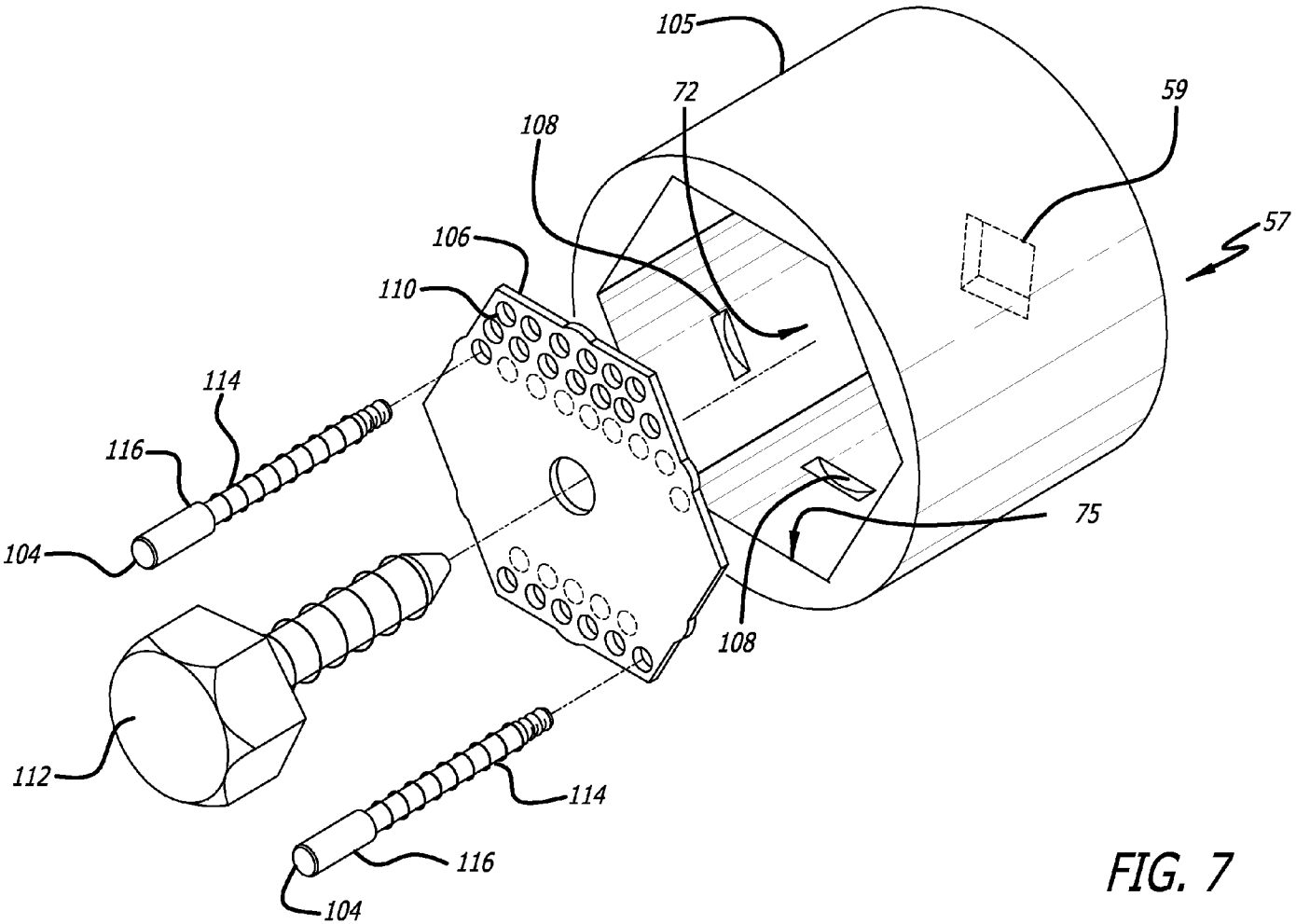
FIG. 7 is an exploded, perspective view of the self-adjusting socket tool of FIG. 5 showing a biasing device comprising a perforated frame retained within notches formed in the cavity of the socket and a plurality of springs coiled around the plurality of movable pins.

FIGS. 6 and 7 show a self-adjusting, universal socket tool 57 that may be temporarily or permanently attached to the handles shown in FIGS. 1-5. The self-adjusting socket tool 75 has an adjusting mechanism 102 that adjusts for the size of the bolt head or nut in a variety of fasteners. The self-adjusting socket tool 57 may be of the type disclosed in U.S. Pat. Nos. 5,622,090, 5,791,209, and 6,928,906 to Marks, the entire contents of which are hereby incorporated by reference. As shown in the exemplary embodiments of FIGS. 6 and 7, the adjusting mechanism 102 includes a plurality of elongate pins 104 disposed within the forward recess 72 of the socket tool 57. The elongate pins 104 extend axially within the forward recess 72 and are able to move independently of each other in an axial direction. The elongate pins 104 are attached to the body 105 of the self-adjusting socket tool 57 by a perforated plate or frame 106 which is retained by notches 108 formed in the inner surface 75 of the body 105. Each elongate pin 104 is biased by a spring 114 away from the frame 106 and out of the body 105. The perforations 110 in the frame 106 are arranged so that the elongate pins 104 are generally parallel to each other and act as a bundled. An optional, movable spacer pin 112 may be located at the center of the bundle of elongate pins 104, which reduces total number of elongate pins required to fill the forward recess 72 and helps guide the socket tool 57 on to a bolt head.

Preferably, a coiled spring 114 is disposed around the shaft of each of the elongate pins 104, with one end of the spring pushing against a shoulder 116 formed on the elongate pin and the opposite end of the spring pushing against the frame 106. The springs 114 bias the elongate pins 104 to move toward the forward position (shown in FIG. 6) when the socket tool is pulled away from a fastener, and bring compliance into the adjusting mechanism 102. Of course, other types of springs and biasing devices may be used. When in the forward position, the elongate pins 104 are preferably located entirely within the forward recess 72 of the inner surface 75. The elongate pins 104 may extend outside of the forward recess 72 in other embodiments. When the self-adjusting socket tool 57 is pushed onto a fastener having a given size and shape, the compliance in the adjusting mechanism 102 adapts the elongate pins 104—allowing some to be pushed into the body 105—to the given size and shape of the fastener. The remaining pins 104 are bundled and surround the fastener, ready to transmit torque to the fastener. Still other types of socket tools may of course be used with the handle 10 described earlier.

While several particular forms of the invention have been illustrated and described, it will also be apparent that various modifications can be made without departing from the scope of the invention. Other types of socket tools or tool bits may be attached to the handle. Examples of other types of tools include, without limitation, screwdriver bits and Torx bits. Further, the handle and its socket tool or tool bit can be used to apply torque to fasteners such as screws, bolts, rivets, nuts, cap nuts, wing nuts, or gas or water line valve stems, spigots, drain plugs, stripped nuts, etc. It is also contemplated that various combinations or subcombinations of the specific features and aspects of the disclosed embodiments can be combined with or substituted for one another in order to form varying modes of the invention. Accordingly, it is not intended that the invention be limited, except as by the appended claims.

What is claimed is:

1. A ratcheting handle for a tool, the handle comprising:

a ratchet device including a means for ratcheting, a lock mechanism, a forward portion, and a rear portion, the ratchet device configured such that the rear portion is rotatable relative to the forward portion, the lock mechanism movable between a first orientation in which the rear portion is prevented from rotating in a first direction relative to the forward portion and a second orientation in which the rear portion is prevented from rotating in a second direction relative to the forward portion;

a grip attached to the rear portion of the ratchet device, wherein the grip includes a forward flange;

a tool adapter attached to the forward portion of the ratchet device and for securing a portion of the tool to the forward portion; and a selector coupled to the lock mechanism and abutting the forward flange of the grip, the selector including an outward facing surface and an inward facing surface, the outward facing surface positioned to be manipulated by a user of the handle to move the lock mechanism from the first orientation to the second orientation and from the second orientation to the first orientation, the inward facing surface spaced apart from the tool adapter and located to be adjacent to the portion of the tool attached to the tool adapter.

2. The handle of claim 1, wherein the selector includes a cylindrical inward facing surface surrounding the tool adapter having an inner diameter with a gap to accommodate an outside diameter of the tool attached to the tool adapter, wherein the gap is about 0.030 ±0.002 inch.

3. The handle of claim 1, wherein the selector includes a cylindrical outward facing surface and a plurality of grooves formed in the cylindrical outward facing surface.

4. The handle of claim 1, wherein the selector includes a forward cylindrical outward facing surface having a first outer diameter and a rear cylindrical outward facing surface having a second outer diameter greater than the first outer diameter, the rear cylindrical outward facing surface having grooves located adjacent the grip.

5. The handle of claim 1, wherein:

the selector includes a cylindrical outward facing surface having an outer diameter; and the grip includes a circular outer surface adjacent the cylindrical outward facing surface of the selector, the outer surface having an outer diameter substantially equivalent to the outer diameter of the cylindrical outward facing surface.

6. The handle of claim 1, wherein a forward aperture and a rear aperture are formed in the selector, the forward aperture sized to receive the tool, the rear aperture sized to receive the forward portion of the ratchet device.

7. The handle of claim 1, wherein:

the selector includes a forward end and a tool recess extending rearwardly from the forward end, the tool recess sized to receive the tool; and the tool adapter includes a forward tip disposed within the tool recess and to the rear of the forward end of the selector.

8. The handle of claim 1, wherein the tool adapter includes a drive block including a side surface and a pushing surface protruding from and movable relative to the side surface of the drive block, the drive block sized to fit into the tool.

9. The handle of claim 1, wherein:

the selector includes a rear end; and the grip includes a substantially flat support surface abutting the rear end of the selector.

10. The handle of claim 1, wherein:

the ratchet device has a rotational axis about which the rear portion is capable of rotating relative to the forward portion; and the grip includes a first gripping portion and a second gripping portion smaller than the first gripping portion, the first gripping portion including a first forward facing surface defining at a first angle wherein the first forward facing surface extends entirely below the rotational axis, the second gripping portion including a second forward facing surface defining a second angle wherein the second forward facing surface extends entirely above the rotational axis.

11. The handle of claim 1, further comprising a pin extending through an aperture formed through the selector and into a recess formed in the ratchet device.

12. A ratcheting socket tool for applying torque to a fastener, the tool comprising:

a ratchet device including a means for ratcheting, a lock mechanism, a forward portion, and a rear portion, the ratchet device configured such that the rear portion is rotatable relative to the forward portion, the lock mechanism movable between a first orientation in which the rear portion is prevented from rotating in a first direction relative to the forward portion and a second orientation in which the rear portion is prevented from rotating in a second direction relative to the forward portion;

a grip attached to the rear portion of the ratchet device;

a socket device including a forward segment, a recess formed in the forward segment, and a rear segment attached to the forward portion of the ratchet device, the recess sized to receive at least a portion of the fastener;

a selector coupled to the lock mechanism, the selector including a forward end, an inward facing surface, an outward facing surface, and a forward aperture formed at the forward end and sized to receive the socket device, the inward facing surface surrounding the rear segment of the socket device, the outward facing surface positioned to be manipulated by a user of the tool to move the lock mechanism from the first orientation to the second orientation and from the second orientation to the first orientation;

the rear segment of the socket device is removably attached to the forward portion of the ratchet device; and the forward portion includes a drive block having a side surface and a pushing surface protruding from and movable relative to the side surface of the drive block, the drive block sized to be inserted into and removed from the rear segment of the socket device.

13. The tool of claim 12, wherein the socket device includes a plurality of elongate pins disposed within the recess of the socket device, the pins moving independently of each other from a forward position to a rear position when the socket device is pushed onto the fastener, the socket device further including a biasing device urging the pins to move toward the forward position when the socket device is pulled from the fastener.

14. A self-adjusting socket tool for applying torque to a fastener having a predetermined size, the tool comprising:

a ratchet device including a means for ratcheting, a lock mechanism, a forward portion, and a rear portion, the ratchet device configured such that the rear portion is rotatable relative to the forward portion, the lock mechanism movable between a first orientation in which the rear portion is prevented from rotating in a first direction relative to the forward portion and a second orientation in which the rear portion is prevented from rotating in a second direction relative to the forward portion, wherein the tool includes an axis of rotation and the grip includes triangular shaped grip portions with peaks located away from the axis of rotation;

a grip attached to the rear portion of the ratchet device including a substantially flat support surface;

a socket device including a forward segment, a recess formed in the forward segment, an adjusting mechanism disposed within the recess, and a rear segment attached to the forward portion of the ratchet device, the recess sized to receive at least a portion of the fastener, the adjusting mechanism moving in accordance with the predetermined size of the fastener when the socket device is pushed onto the fastener; and a selector coupled to the lock mechanism and having a rear end that abuts the substantially flat support surface of the grip, the selector further including a forward end, an inward facing surface, an outward facing surface, and a forward aperture formed at the forward end and sized to receive the socket device, the inward facing surface surrounding the rear segment of the socket device, the outward facing surface positioned to be manipulated by a user of the tool to move the lock mechanism from the first orientation to the second orientation and from the second orientation to the first orientation.

15. The tool of claim 14, wherein:

the adjusting mechanism includes a plurality movable pins extending axially within the recess of the socket device, the pins moving axially and independently of each other between a forward position and a rear position; and the pins are attached to the socket device such that when the socket device is pushed onto the fastener, a first number of the pins move from the forward position to the rear position and a second number of the pins remain at the forward position, and when torque is applied to the grip by a user, the applied torque is transferred to the fastener by the second number of the pins.

16. The tool of claim 14, wherein grip includes a curved, convex shaped rearward facing surface to allow axial pressure to be applied to the tool.

17. The tool of claim 14, wherein the triangular shaped grip portions are defined respectively by a first angle and a second angle on opposite sides of the axis of rotation, wherein about 20°≦first angle≦about 40° and about 35°≦second angle≦about 80°.

* * * * *